US012162579B1

(12) United States Patent
Schrank et al.

(10) Patent No.: US 12,162,579 B1
(45) Date of Patent: Dec. 10, 2024

(54) INTEGRATED COPILOT AND LOCKING MECHANISM FOR MARINE DRIVES

(71) Applicant: Brunswick Corporation, Mettawa, IL (US)

(72) Inventors: Devan L. Schrank, Fond du Lac, WI (US); Robert A. Podell, Slinger, WI (US); Jay M. Albulushi, Jackson, WI (US)

(73) Assignee: Brunswick Corporation, Mettawa, IL (US)

( * ) Notice: Subject to any disclaimer, the term of this patent is extended or adjusted under 35 U.S.C. 154(b) by 477 days.

(21) Appl. No.: 17/509,739

(22) Filed: Oct. 25, 2021

(51) Int. Cl.
*B63H 20/12* (2006.01)
*B63H 20/04* (2006.01)

(52) U.S. Cl.
CPC ..... *B63H 20/12* (2013.01); *B63H 20/04* (2013.01)

(58) Field of Classification Search
CPC ..... B63H 20/12; B63H 20/04
See application file for complete search history.

(56) References Cited

U.S. PATENT DOCUMENTS

| | | | |
|---|---|---|---|
| 1,451,452 | A | 4/1923 | Totten |
| 2,549,481 | A | 4/1951 | Kiekhaefer |
| 2,808,218 | A | 10/1957 | Steller |
| 3,922,996 | A | 12/1975 | Meyer |
| 3,961,595 | A | 6/1976 | Meyer |
| 4,018,104 | A | 4/1977 | Bland et al. |
| 4,521,201 | A | 6/1985 | Watanabe |
| 4,701,141 | A | 10/1987 | Sumigawa |
| 5,102,357 | A | 4/1992 | Bruesch et al. |
| 5,180,319 | A | 1/1993 | Shiomo |
| 5,340,342 | A | 8/1994 | Boda et al. |
| 5,582,527 | A | 12/1996 | Nakamura |
| 6,053,471 | A | 4/2000 | Brown |
| 6,146,221 | A | 11/2000 | Natsume |
| 6,174,211 | B1 | 1/2001 | Nakamura |

(Continued)

FOREIGN PATENT DOCUMENTS

| | | |
|---|---|---|
| CN | 206590092 | 10/2017 |
| EP | 1101696 | 5/2001 |

(Continued)

OTHER PUBLICATIONS

Fergus, Ryan A., Unpublised U.S. Appl. No. 17/487,116, "Outboard Motor That Is Removable From Transom Clamp Bracket".

(Continued)

*Primary Examiner* — Anthony D Wiest
(74) *Attorney, Agent, or Firm* — Andrus Intellectual Property Law, LLP

(57) ABSTRACT

An apparatus is for removably supporting a marine drive on a marine vessel. The apparatus has a transom bracket assembly for mounting to the marine vessel, a steering bracket for coupling the marine drive to the transom bracket assembly so the marine drive is steerable relative to the transom bracket assembly and the marine vessel; and an integrated copilot and locking mechanism configured to retain the steering bracket in a plurality of steering orientations. The mechanism is further configured to lock and alternately unlock the steering bracket relative to the transom bracket assembly such that in a locked position the marine drive is retained on the transom bracket assembly and such that in an unlocked position the marine drive is removable from the transom bracket assembly.

20 Claims, 7 Drawing Sheets

(56) References Cited

U.S. PATENT DOCUMENTS

| | | | |
|---|---|---|---|
| 6,283,806 | B1 | 9/2001 | Schmidt et al. |
| 6,659,817 | B1 | 12/2003 | Anderson et al. |
| 6,902,450 | B2 | 6/2005 | Ohtsuki et al. |
| 7,048,600 | B1 | 5/2006 | Broussard |
| 7,090,551 | B1 | 8/2006 | Okken et al. |
| 7,244,152 | B1 | 7/2007 | Uppgard |
| 7,297,035 | B2 | 11/2007 | Broussard |
| 7,303,595 | B1 | 12/2007 | Janitz |
| 7,314,396 | B2 | 1/2008 | Kubota et al. |
| 7,410,397 | B2 | 2/2008 | Nakamura et al. |
| 7,681,513 | B1 | 3/2010 | Hundertmark |
| 7,896,304 | B1 | 3/2011 | Eichinger et al. |
| 8,069,803 | B1 | 12/2011 | Crawford |
| 8,795,010 | B1 | 8/2014 | Wiatrowski |
| 8,820,701 | B1 | 9/2014 | Eichinger |
| 9,205,906 | B1 | 12/2015 | Eichinger |
| 9,376,191 | B1 | 6/2016 | Jaszewski |
| 9,463,859 | B1 | 10/2016 | Cooper, III et al. |
| 9,481,434 | B1 | 11/2016 | Eichinger et al. |
| 9,616,986 | B1 | 4/2017 | Gilk et al. |
| 9,623,946 | B2 | 4/2017 | Delise |
| 9,643,703 | B1 | 5/2017 | Eichinger |
| 9,701,383 | B1 | 7/2017 | Stuber et al. |
| 9,764,813 | B1 | 9/2017 | Zarembka et al. |
| 9,783,278 | B1 | 10/2017 | Dannenberg et al. |
| 9,789,945 | B1 | 10/2017 | Vaninetti et al. |
| 9,963,213 | B1 | 5/2018 | Jaszewski et al. |
| 9,969,475 | B1 | 5/2018 | Waisanen |
| 10,005,536 | B2 | 6/2018 | Fukuchi |
| 10,124,871 | B1 | 11/2018 | Eichinger et al. |
| 10,246,173 | B1 | 4/2019 | Ingebritson |
| 10,464,648 | B1 | 11/2019 | Amerling et al. |
| 10,696,367 | B1 | 6/2020 | Ingebritson et al. |
| 10,787,236 | B1 | 9/2020 | Erickson et al. |
| 11,066,140 | B1 | 7/2021 | Huffer et al. |
| 11,097,824 | B1 | 8/2021 | Anderson, Jr. |
| 2009/0001244 | A1 | 1/2009 | Lucier et al. |
| 2009/0170384 | A1 | 7/2009 | Balogh et al. |
| 2011/0065340 | A1 | 3/2011 | Klawitter et al. |
| 2023/0192260 | A1 | 6/2023 | Dannenberg et al. |

FOREIGN PATENT DOCUMENTS

| | | |
|---|---|---|
| EP | 4155191 | 3/2003 |
| JP | 3976290 | 8/1976 |
| JP | S5654697 | 5/1981 |
| JP | S6479000 | 3/1989 |
| WO | 2022045986 | 3/2022 |

OTHER PUBLICATIONS

"PPF Mud Motors, "Quick Drop Transom Mount," website, available at least as early as Sep. 15, 2017, lastaccessed Jul. 5, 2021, available at http://ppfmudmotors.com/quick-drop-transom-mount/ - this is the webpagescreenshot".

Evinrude, Evinrude E-Tec 25 HP, last accessed May 11, 2021, available at: https://www.evinrude.com/en-US/e-tec/e-tec-full-specs.html#tab=12.

Evinrude, Evinrude E30DTSLAFD Tiller Arm Diagram, last accessed May 11, 2021, available at: https://www.boats.net/catalog/evinrude/outboard-by-year/af-models/e30dtslafd/tiller-arm.

Honda Marine, BF25D•BF30D Owner's Manual, 2017 Honda Motor Co., Ltd.

Honda Marine, Honda Marine BF25hp Parts List, last accessed Dec. 4, 2018, available at: http://peparts.honda.com/marine#/serial.

Honda Marine, Honda BF25-30hp, last accessed May 11, 2021, available at: https://marine.honda.com/outboards/motor-detail/BF25-30#specs.

Mercury Marine, 2010 Mercury Marine 25hp Owner's Manual.

Mercury Marine, 2015 Mercury Marine 15/20 FourStroke Outboard Installation Operation Maintenance Warranty Manual.

Suzuki Motor Corporation, DF25A-DF30A Owner's Manual, Oct. 2015.

Suzuki Motor Corporation, Suzuki DF 30A Parts Listings, last accessed Dec. 4, 2018, available at: https://www.brownspoint.com/store/pc/BP_AP_AssemblyDetail.asp?ID=19761.

Yamaha Motor Co., Ltd., Yamaha 25hp Parts List, last accessed Dec. 4, 2018, available at: https://shop.yamahaonlineparts.com/OEMpartfinder.htm.

Yamaha Motor Co., Ltd., Yamaha F25 T25 Owner's Manual, May 2013.

Yamaha Motor Co., Ltd., 2013 Yamaha Outboard 30hp—F30LA Steering Friction Section, last accessed Dec. 4, 2018, available at: https://www.crowleymarine.com/yp/KE329296/steering-friction-f30la-2013-30hp.

Yamaha Motor Co., Ltd., 2013 Yamaha Outboard 30hp—F30LA, Bracket 1 Section, last accessed Dec. 4, 2018, available at: crowleymarine.com.

Yamaha Motor Co., Ltd.,Yamaha 30hp Co-Pilot Manual, Feb. 2010.

Remigo, E-Outboard, webpage and 5 photographs, Sep. 26, 2020, available at https://web.archive.org/web/20200926115717/https://remigo.eu/.

Declaration of Prior Art submitted in U.S. Appl. No. 17/852,944.

Unpublished U.S. Appl. No. 17/509,739.

Unpublished U.S. Appl. No. 17/852,944.

INTEGRATED COPILOT AND LOCKING MECHANISM FOR MARINE DRIVES

FIELD

The present disclosure relates to an integrated co-pilot and locking mechanism for a marine drive, which in particular facilitates efficient control of co-pilot steering, as well as installation and removal of the marine drive from the marine vessel.

BACKGROUND

The following are incorporated herein by reference, in entirety.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 11,097,824 discloses an apparatus for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An apparatus is for removably supporting a marine drive on a marine vessel. The apparatus comprises a transom bracket assembly for mounting to the marine vessel, a steering bracket for coupling the marine drive to the transom bracket assembly so the marine drive is steerable relative to the transom bracket assembly and the marine vessel, and an integrated copilot and locking mechanism configured to retain the steering bracket in a plurality of steering orientations, and being further configured to lock and alternately unlock the steering bracket relative to the transom bracket assembly such that in a locked position the marine drive is retained on the transom bracket assembly and such that in an unlocked position the marine drive is removable from the transom bracket assembly.

In nonlimiting examples, the mechanism comprises a copilot arm for retaining a steering bracket on the marine drive in each of a plurality of steering orientations, and a locking arm configured to lock and alternately unlock the steering bracket relative to the transom bracket assembly.

In nonlimiting examples, the transom bracket assembly comprises a swivel cylinder and the steering bracket comprises a steering arm and a swivel tube assembly that is seated in the swivel cylinder such that steering of the steering arm relative to the transom bracket assembly rotates the swivel tube assembly in the swivel cylinder. The mechanism further has a copilot arm that engages with the swivel tube assembly to limit or prevent rotation of the swivel tube assembly in the swivel cylinder thereby retaining the steering bracket in each of the plurality of steering orientations.

BRIEF DESCRIPTION OF THE DRAWINGS

Examples are described with reference to the following drawing figures. The same numbers are used throughout to reference like features and components.

DETAILED DESCRIPTION

During research and development in the field of marine propulsion devices, the present inventors determined it would be advantageous to provide improved locking apparatuses for removably coupling a marine drive, for example an outboard motor, to a marine vessel. Further, the present inventors determined it would be advantageous to provide improved copilot apparatuses for selectively retaining the marine drive in various steering orientations. Further, the present inventors determined it would be advantageous to integrate a copilot apparatus with a locking apparatus, in particular to provide a more efficient and effective means for collectively locking, unlocking, and retaining the steering orientation of the marine drive relative to the marine vessel, which advantageously reduces chance of user error, limits the chance of accidentally damaging the apparatus, and enhances overall user experience.

Figure 1:
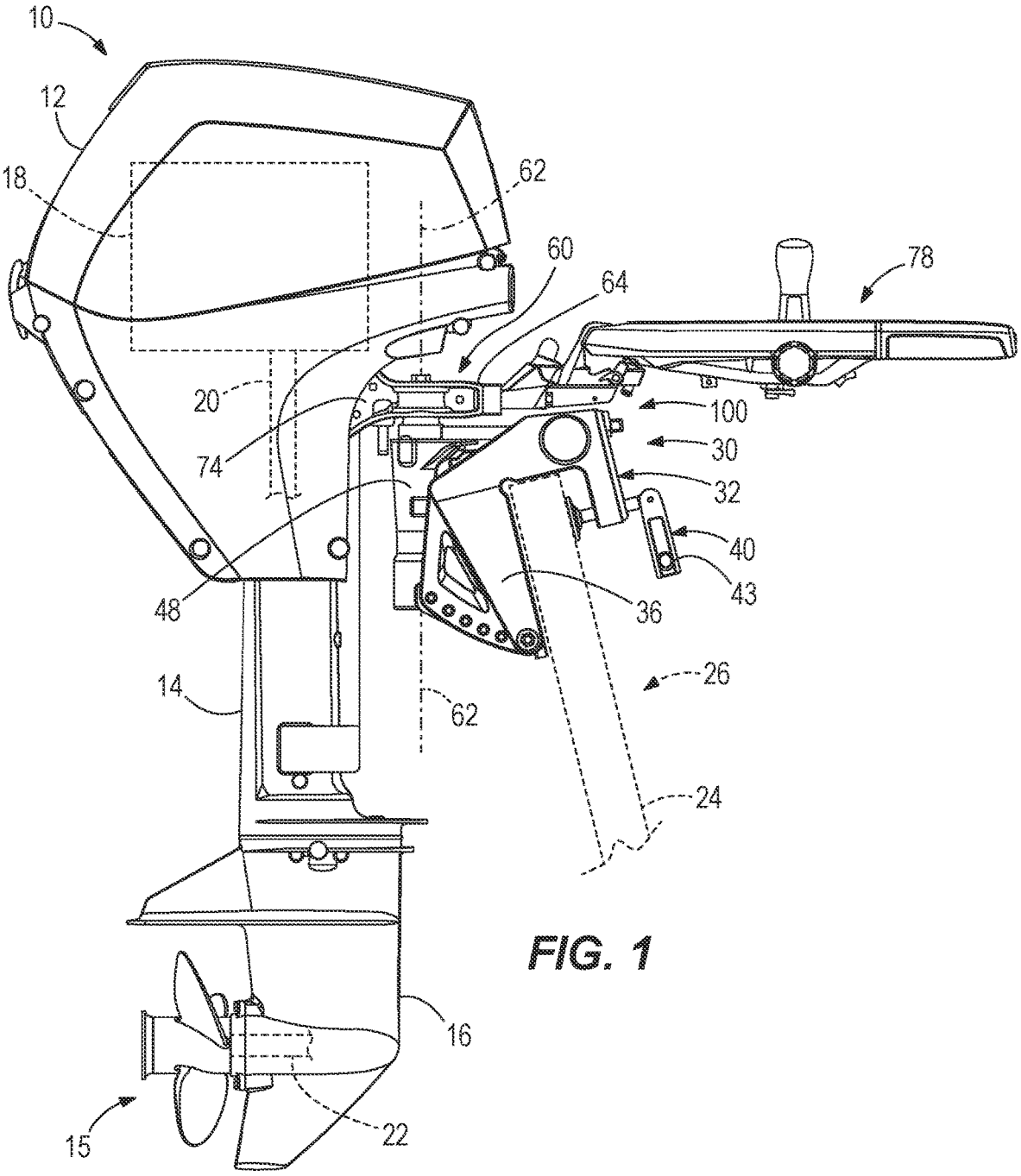
FIG. 1 is a side view of a marine drive supported on the transom of a marine vessel by an apparatus according to the present disclosure.

FIG. 1 depicts a marine drive, which in the illustrated example is an outboard motor 10. The outboard motor 10 has an upper cowling 12 and a driveshaft housing 14 extending downwardly from the upper cowling 12 to a lower gearcase 16. A powerhead 18 is covered by the upper cowling 12. The powerhead 18 causes rotation of a driveshaft 20 which extends from the powerhead 18 through the driveshaft housing 14 and into operative engagement with a propeller shaft 22 supported for rotation in the lower gearcase 16. The powerhead 18 can include an electric motor and/or an engine and/or any other conventional means for causing rotation of the driveshaft 20. Rotation of the driveshaft 20 causes rotation of the propeller shaft 22, which in turn causes rotation of a propeller 15. The type and configuration of the marine drive can vary from what is shown and in other examples can include a forward-facing or tractor-type propeller configuration, an impeller, and/or any other known means for generating a propulsive force for propelling a marine vessel in water.

Figure 2:
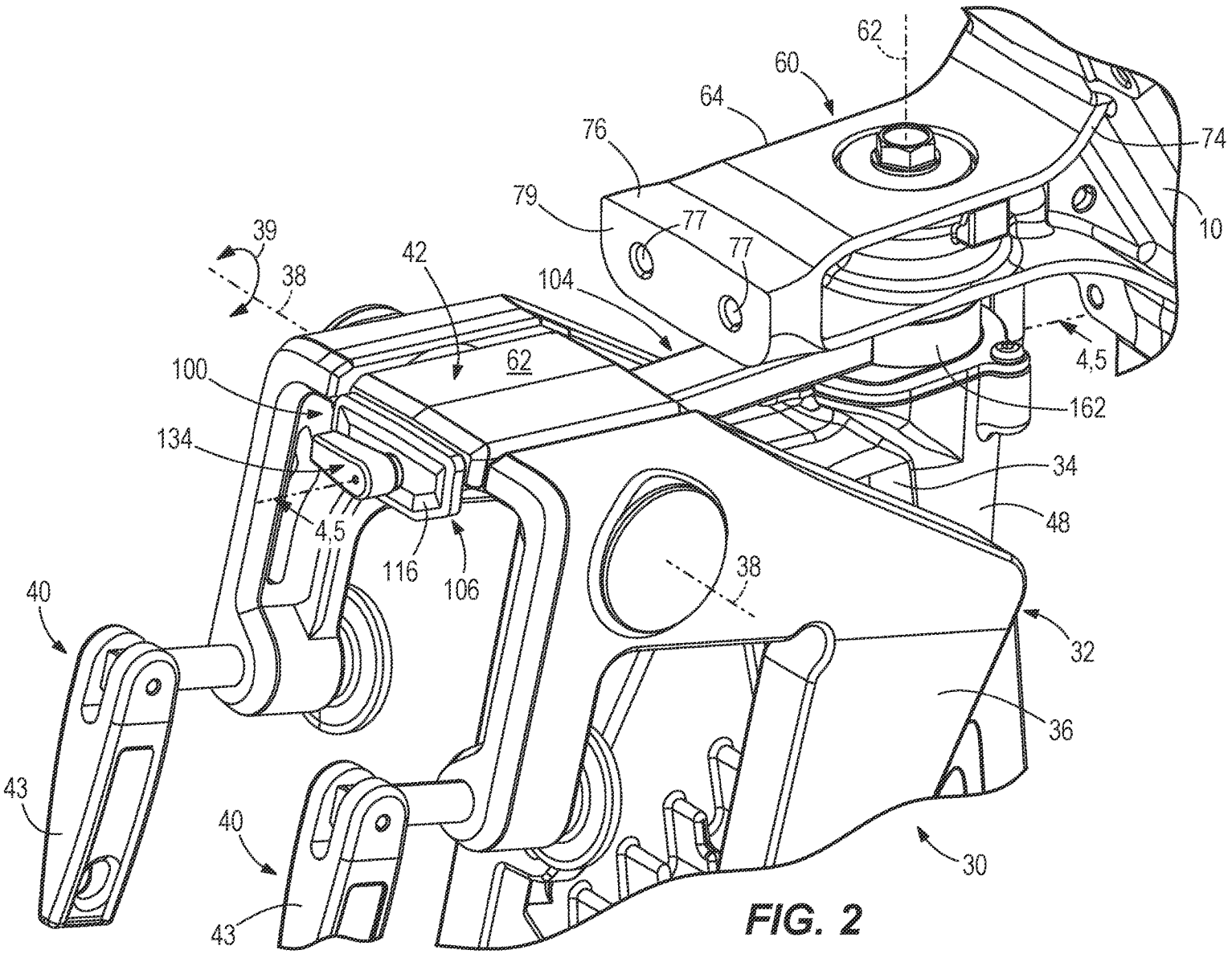
FIG. 2 is a closer view of the apparatus, including a transom bracket assembly, a swivel bracket, and an integrated copilot and locking mechanism.

Referring to FIGS. 1 and 2, the outboard motor 10 is coupled to the transom 24 of a marine vessel 26 by a transom bracket assembly 30 which in the illustrated example includes a transom bracket 32 fixed to the transom 24 and a swivel bracket 34 pivotably coupled to the transom bracket 32. The transom bracket 32 has a pair of C-shaped arms 36 that fit over the top of the transom 24 and a pair of threaded, plunger-style clamps 40 that clamp the C-shaped arms 36 to the transom 24. Rotation of handles 43 in one direction clamps the transom 24 between the C-shaped arms 36 and plunger-style clamps 40. Rotation of the handles 43 in the opposite direction frees the C-shaped arms 36 for removal from the transom 24. The type and configuration of the transom bracket 32 can vary from what is shown and described. In other examples, the transom bracket 32 is fixed to the transom 24 by fasteners.

The swivel bracket 34 is pivotably coupled to the upper end of the C-shaped arms 36 along the trim axis 38 such that the swivel bracket 34 is pivotable (trimmable) up and down about the trim axis 38 in the direction of arrows 39. Reference is made to the above-incorporated U.S. patents, which show similar conventional arrangements facilitating pivoting movement of a swivel bracket relative to a transom bracket. This is a conventional arrangement and thus is not further discussed herein. It should also be mentioned for completeness that for the purposes of the present invention, the transom bracket assembly 30 does not have to have a swivel bracket that is pivotable (trimmable) relative to a transom bracket. In other arrangements, the transom bracket assembly could be comprised of a single monolithic component or could be comprised of more than one component which are not pivotable about a trim axis.

Figure 3:
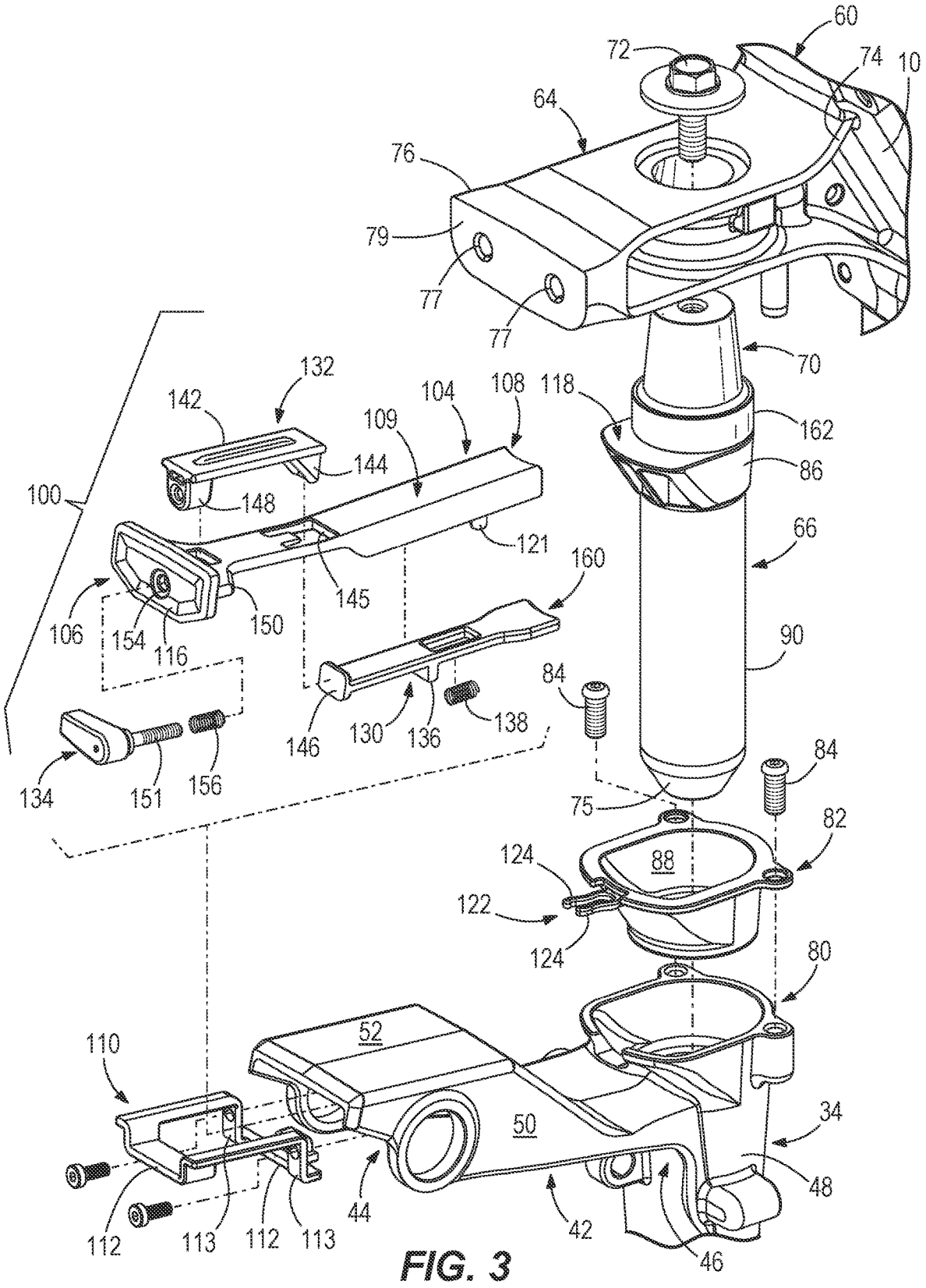
FIG. 3 is an exploded view of the apparatus shown in FIG. 2.
Figure 4:
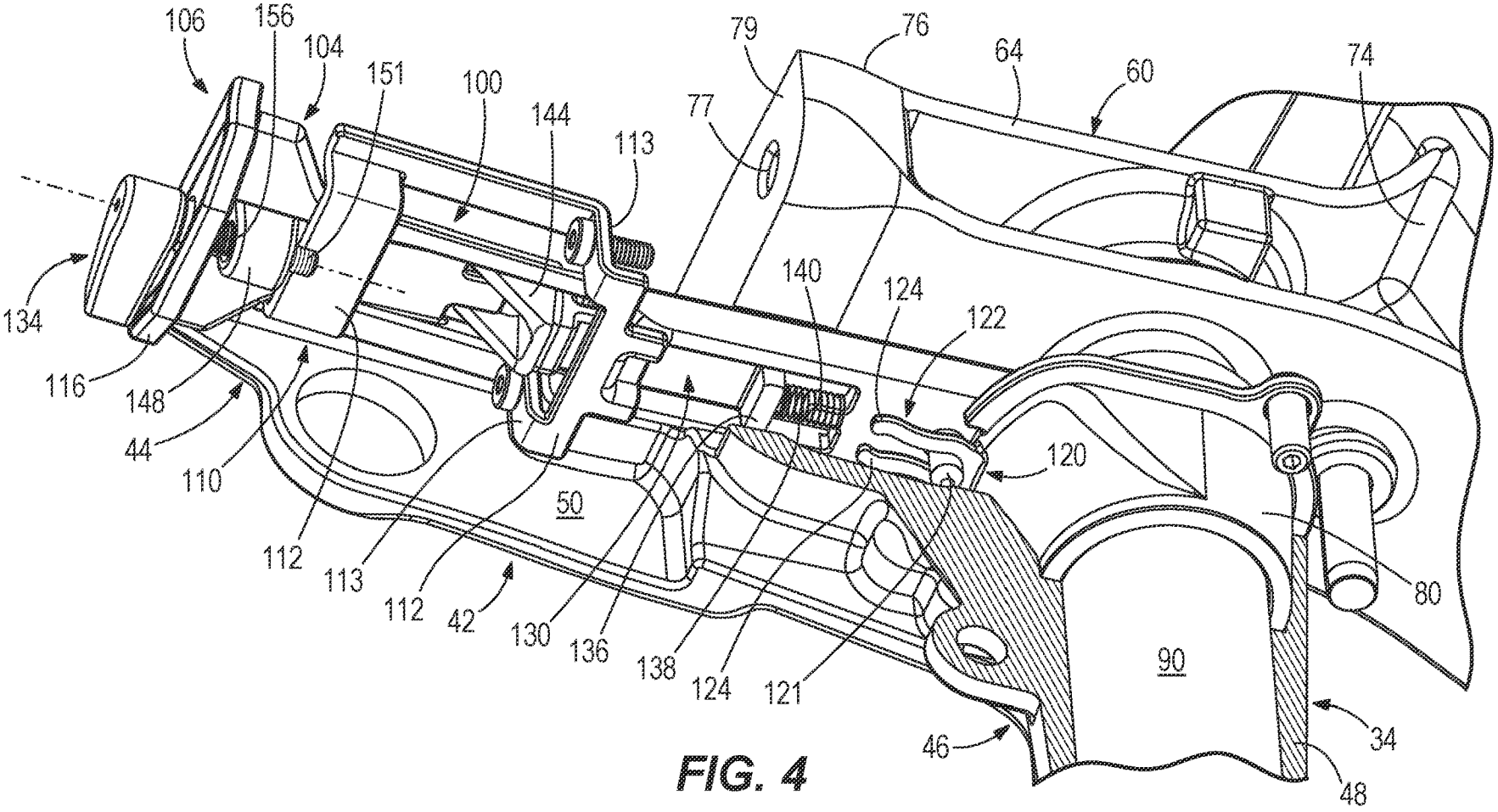
FIG. 4 is a view of section 4-4, taken in FIG. 2.

Referring now to FIG. 3, the swivel bracket 34 includes a swivel arm 42 having a first end 44 that is pivotably coupled to the C-shaped arms 36 of the transom bracket 32, along the trim axis 38. The swivel arm 42 has an opposite, second end 46 that is fixed to or formed with an elongated swivel cylinder 48, which is further described herein below with reference to FIG. 5. As best shown in FIGS. 3 and 4, the first end 44 of the swivel arm 42 has a pair of sidewalls 50 and a top wall 52 that connects the sidewalls 50. An axial passage 54 (see FIG. 5) is formed through the middle of the swivel arm 42, between the first and second ends 44, 46, and generally next to the top wall 52 and next to and between the sidewalls 50.

Referring to FIGS. 1-3, a steering bracket 60 is fixed to and extends from the outboard motor 10, generally along the midsection of the outboard motor 10, adjacent the lower portion of the upper cowling 12 and the upper portion of the driveshaft housing 14. As will be further described herein below, the steering bracket 60 facilitates removable coupling of the outboard motor 10 to the transom bracket assembly 30, i.e., so that the outboard motor 10 is steerable relative to the transom bracket assembly 30 about a steering axis 62 and also so that the outboard motor 10 is removable from the transom bracket assembly 30 for transport along with the outboard motor 10. The steering bracket 60 has a steering arm 64 and a swivel tube assembly 66. The swivel tube assembly 66 is cylindrical, having a smooth outer surface that extends generally transversely to the steering arm 64 from an upper end 70 fixed to a middle portion of the steering arm 64 by a fastener 72 to a conical lower end 75. The steering arm 64 has a first end 74 that is fixed to a supporting frame or other component of the outboard motor 10, as described herein above, and an opposite, second end 76 fixed to a conventional tiller handle 78, shown in FIG. 1, by fasteners extending through bores 77 in the end wall 79 of the steering arm 64. The type and configuration of the tiller handle 78 can vary from what is shown. The illustrated example is the tiller handle disclosed in the presently-incorporated U.S. Pat. No. 9,764,813.

Referring to FIG. 3, the outboard motor 10 is installed onto the swivel bracket 34 by lowering the swivel tube assembly 66 into the swivel cylinder 48, as shown by dash-and-dot line in FIG. 3. The swivel cylinder 48 has a widened mouth 80. A receiver cup 82 is nested in the widened mouth 80 and affixed thereto by fasteners 84. An annular locking flange 86 is fixed to the upper end 70 of the swivel tube assembly 66. The receiver cup 82 and annular locking flange 86 have complementary inner and outer shapes, respectively, and as such are configured so that the annular locking flange 86 nests in the receiver cup 82 as the swivel tube assembly 66 is lowered into and seated in the swivel cylinder 48. The receiver cup 82 has an inner funnel surface 88 that centrally funnels the conical lower end 75 of the swivel tube assembly 66 into the swivel cylinder 48 as the swivel tube assembly 66 is lowered into the receiver cup 82. The smooth outer surface of the swivel tube assembly 66 facilitates sliding of the swivel tube assembly 66 along the smooth inner surface of the swivel cylinder 48 until the annular locking flange 86 engages and nests in the receiver cup 82. Engagement between the outer contours of the annular locking flange 86 with the inner (funnel) contours of the receiver cup automatically aligns the swivel tube assembly 66 about the steering axis 62, particularly into the position shown in FIG. 5.

Figure 5:
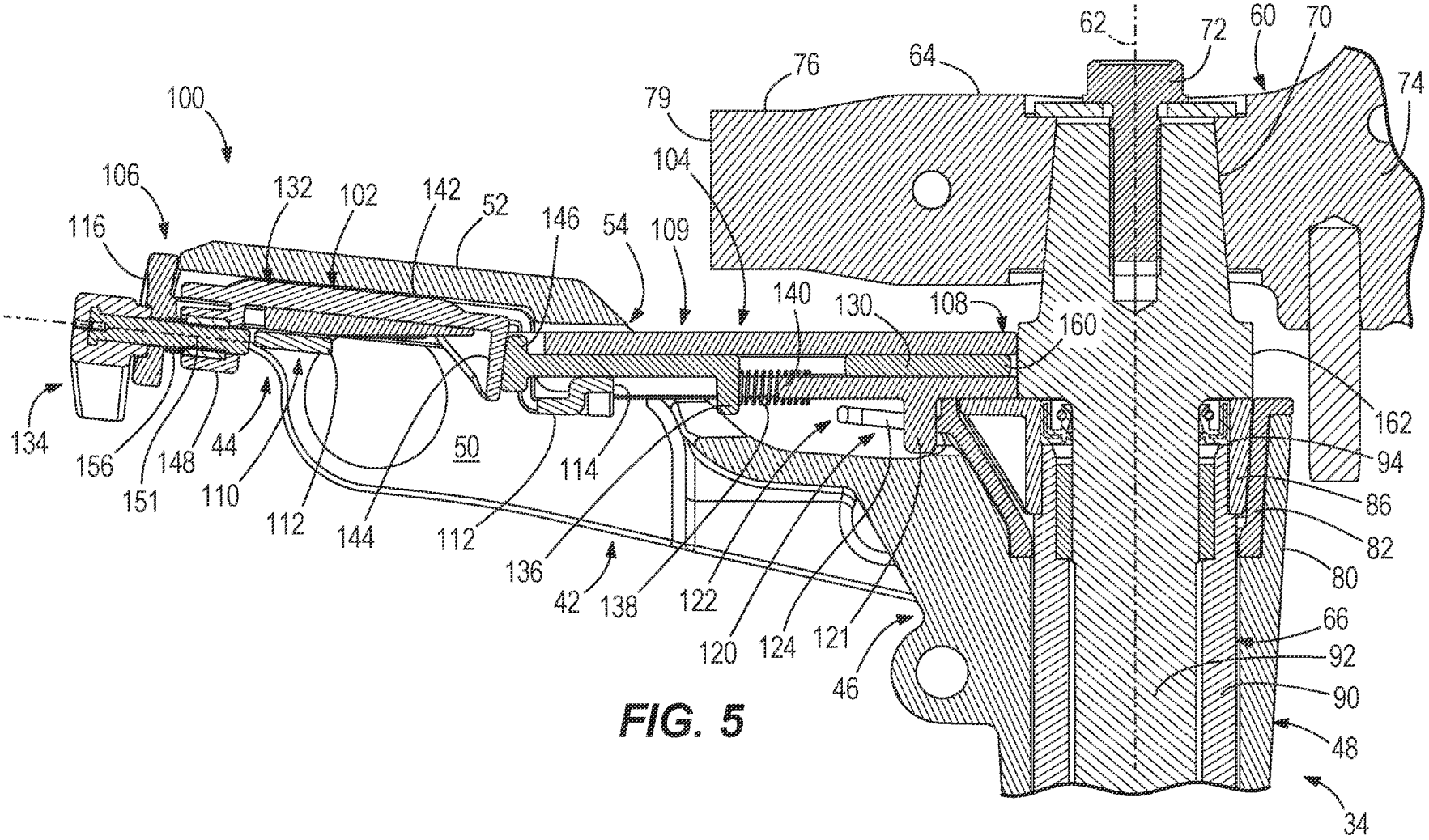
FIG. 5 is a view of section 5-5, taken in FIG. 2, showing the mechanism in a locked position wherein the marine drive is retained on the marine vessel and steerable about a steering axis.

Referring to FIG. 5, the swivel tube assembly 66 has a stationary outer cylinder 90 and a rotatable inner cylinder 92, which is coaxial with and disposed within the outer cylinder 90. The upper end of the inner cylinder 92 is fixed to the steering arm 64 by the fastener 72 such that manually steering the tiller handle 78 about the steering axis 62, as will be further described herein below, rotates the steering arm 64 and the inner cylinder 92 together about the steering axis 62, while the outer cylinder 90 and annular locking flange 86 remain stationary relative to the steering axis 62 due to the noted nested engagement between the annular locking flange 86 and the receiver cup 82. Bearings 94 facilitate rotational (steering) movement of the inner cylinder 92 relative to the outer cylinder 90 of the swivel tube assembly 66.

Now referring to FIGS. 3 and 4, a novel integrated copilot and locking mechanism 100 is configured to retain the steering bracket 60 in a plurality of steering orientations relative to the steering axis 62. The mechanism 100 is also configured to lock and alternately unlock the steering bracket 60 relative to the transom bracket assembly 30 such that in a locked position of the mechanism 100 the outboard motor 10 is retained on the transom bracket assembly 30 and thus on the marine vessel 26, and such that in an unlocked position of the mechanism 100 the outboard motor 10 is removable therefrom.

Generally, the mechanism 100 has a copilot arm 102 (consisting of several components in the illustrated embodiment) for retaining the steering bracket 60 in a selected steering orientation about the steering axis 62 and for releasing the steering bracket 60 so that the outboard motor 10 is freely steerable about the steering axis 62. The mechanism 100 also has a locking arm 104 for locking and for alternately unlocking the steering bracket 60 and thus the outboard motor 10 relative to the transom bracket assembly 30 and thus the marine vessel 26. As shown and described herein below, the copilot arm 102 and the locking arm 104 are parallel and coaxial, with the copilot arm 102 being integrated within the locking arm 104 and supported on and movable relative to the locking arm 104.

Referring to FIGS. 3-4, the locking arm 104 is generally transversely elongated relative to the steering axis 62, extending along the swivel arm 42, perpendicularly relative to the steering axis 62. The locking arm 104 has a first, handle end 106, an opposite second, locking end 108, and a middle portion 109 between the handle end 106 and the locking end 108. The middle portion 109 of the locking arm 104 extends along the swivel arm 42, in particular though the noted axial passage 54. A cradle bracket 110 couples the locking arm 104 to the bottom of the swivel arm 42 so that the locking arm 104 is slidable along the swivel arm 42, radially towards and away from the swivel tube assembly 66. The cradle bracket 110 has opposing cross-arms 112 for supporting the locking arm 104, and opposing bracket arms 113 that are fastened to end walls 114 along the bottom of the steering arm 64, adjacent to the axial passage 54.

Figure 6:
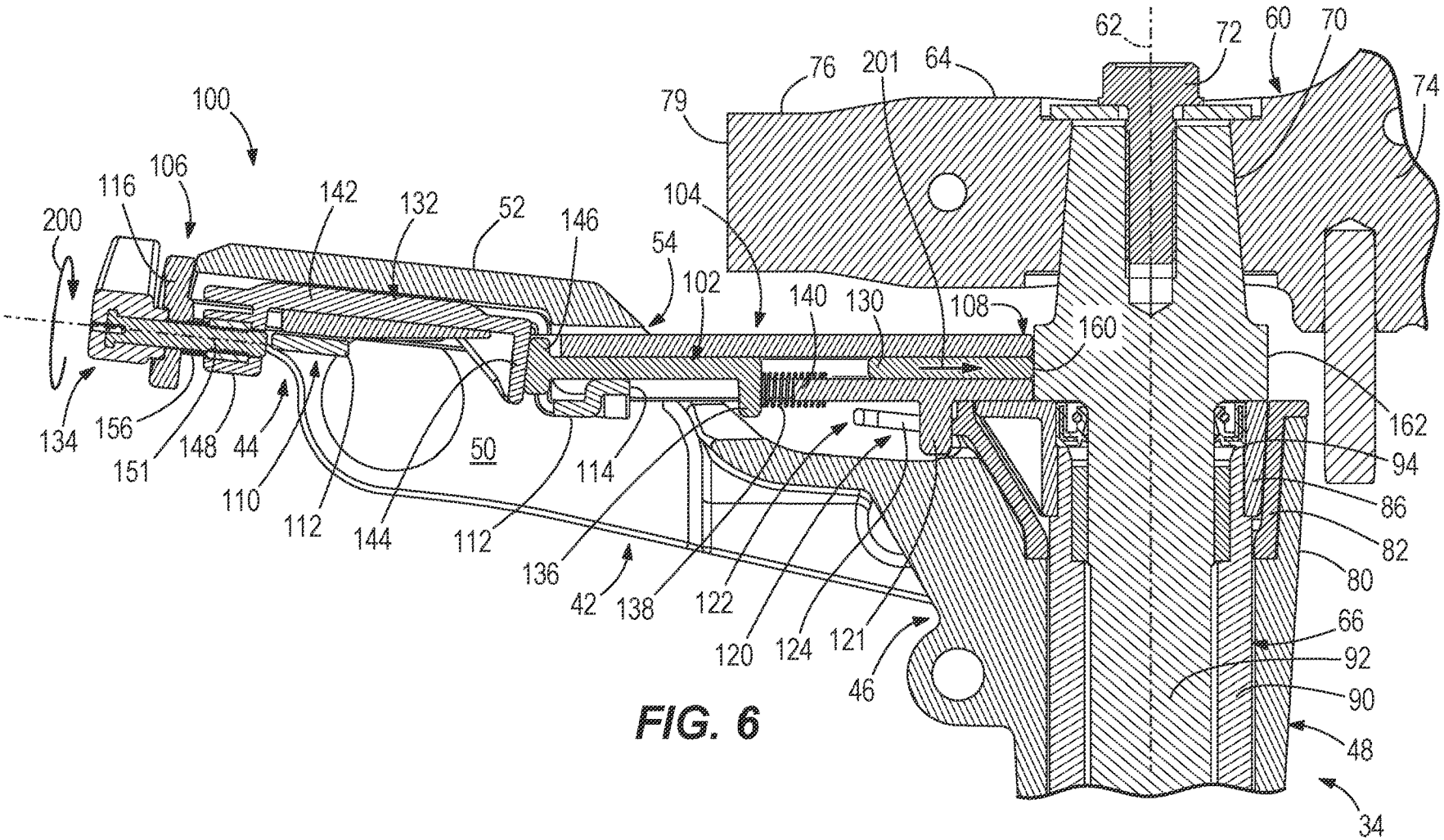
FIG. 6 is a view like FIG. 5, showing the mechanism in the locked position wherein the marine drive is further retained in a steering orientation relative to the steering axis.

An end flange 116 is disposed on the handle end 106. As will be described in further detail herein below with reference to FIGS. 5-8, the end flange 116 provides a locking handle that facilitates manual grasping and pulling/sliding of the locking arm 104 radially outwardly from the swivel tube assembly 66 to remove the locking end 108 from over a top flange 118 (see FIGS. 3 and 7) of the annular locking flange 86 so as to free or unlock the outboard motor 10 for removal from the transom bracket assembly 30. The end flange 116 also facilitates pushing/sliding of the locking arm 104 radially inwardly towards the swivel tube assembly 66 so as to move the locking end 108 over top of the top flange 118 (as shown in FIGS. 5 and 6) for locking the swivel tube assembly 66 on the transom bracket assembly 30 and thus preventing removal of the outboard motor 10 from the transom bracket assembly 30.

A detent device 120 retains the locking arm 104 in a locked position (shown in FIGS. 5-6 and described herein below) and in an unlocked position (shown in FIG. 7 and described herein below). The type and configuration of the detent device can vary from what is shown and described. In the illustrated example, the detent device 120 has a detent protrusion 121 extending from the bottom of the locking end 108 of the locking arm 104 and a spring clip 122 that radially extends from an upper flange on the receiver cup 82. The spring clip 122 has a pair of resilient arms 124 that are contoured so as to define therebetween an open outer end for receiving the detent protrusion 121, a first (outer) recess for retaining the detent protrusion 121 when the locking arm 104 is in the unlocked position, and a second (inner) recess that is located closer to the receiver cup 82 for retaining the detent protrusion 121 when the locking arm 104 is in the locked position.

Referring to FIG. 3, the copilot arm 102 has a friction arm 130, a shuttle 132, and a copilot handle or knob 134. The friction arm 130 and shuttle 132 extend generally parallel to and coaxial with the locking arm 104. The friction arm 130 is disposed in an elongated channel formed through the locking end 108 of the locking arm 104 and is slidable along the locking arm 104. A spring 138 has a first end that abuts an abutment wall 136 on the bottom of the friction arm 130 and an opposite, second end disposed on a spring retention finger 140 (see FIG. 4) on the bottom of the locking end 108 of the locking arm 104. The natural resiliency of the spring 138 pushes the abutment wall 136 and spring retention finger 140 apart, thus biasing the friction arm 130 towards and into engagement with the shuttle 132, as shown in FIG. 4.

The shuttle 132 is embedded in the top of the locking arm 104, in particular having an elongated shuttle body 142, an abutment flange 144 that extends downwardly from the shuttle body 142 through a recess 145 in the middle portion 109 of the locking arm 104 and into engagement with an outer end flange 146 on the friction arm 130, and a threaded boss 148 extending downwardly from the shuttle body 142 through a recess 150 in the handle end 106 of the locking arm 104. The threaded boss 148 is engaged with a threaded shaft 151 on the copilot handle or knob 134, which extends through an unthreaded hole 154 in the end flange 116. A spring 156 has a first end abutting the boss 148 and an opposite, second end abutting the back side of the end flange 116, opposite the copilot handle or knob 134. The natural resiliency of the spring 156 tends to push the shuttle 132 apart from the back side of the end flange 116. Manually rotating the copilot handle or knob 134 in a first direction causes the threaded boss 148 of the shuttle 132 to travel inwardly towards the swivel tube assembly 66, which moves (shuttles) the shuttle 132 inwardly along the locking arm 104. Moving the shuttle 132 inwardly pushes the friction arm 130 inwardly towards the swivel tube assembly 66, until the inner end 160 of the friction arm 130 engages with an annular friction ring 162 on the inner cylinder 92 of the of the swivel tube assembly 66. Optionally the inner end 160 of the friction arm 130 has a concave surface that generally conforms the inner end 160 to the outer surface of the annular friction ring 162, thus facilitating frictional engagement therebetween. Frictional engagement between the inner end 160 and the annular friction ring 162 frictionally retains the steering orientation the inner cylinder 92 and the associated steering arm 64 and thus the outboard motor 10 which is rigidly attached to the steering arm 64.

Conversely, manually rotating the copilot handle or knob 134 in the opposite, second direction causes the threaded boss 148 and associated shuttle 132 to travel (shuttle) outwardly away from the swivel tube assembly 66 along the locking arm 104. Moving the shuttle 132 outwardly allows the natural bias of the spring 138 to move the friction arm 130 away from the annular friction ring 162, thus removing the frictional engagement between the inner end 160 and the annular friction ring 162, which in turn frees the swivel tube assembly 66 and associated outboard motor 10 for steering movement about the steering axis 62, as described herein above.

Advantageously, the copilot arm 102 is configured such that via the degree of rotation of the copilot handle or knob 134, the friction arm 130 is selectively movable inwardly towards and alternately outwardly away from the annular friction ring 162, allowing the user to vary the strength of frictional engagement between the copilot arm 102 and the swivel tube assembly 66, thus providing the ability to selectively vary an amount of resistance against steering motions of the steering bracket 60 relative to the transom bracket assembly 30. Thus, the mechanism 100 permits the user to control the degree of resistance to steering movements of the outboard motor 10 via the tiller handle 78, i.e., according to personal preference. Some users prefer more resistance to steering inputs than others, as a personal choice. The mechanism 100 advantageously permits this characteristic to be selectively varied and set by the user.

FIG. 5 depicts the mechanism 100 in the locked position, in which the steering bracket 60 is retained on the transom bracket assembly 30. The copilot arm 102 is shown disengaged from the swivel tube assembly 66 such that the steering bracket 60 and associated outboard motor 10 are freely steerable about the steering axis 62 via the tiller handle 78. As explained herein above, during installation the swivel tube assembly 66 is lowered into the steering bracket 60 such that the annular locking flange 86 becomes nested in the receiver cup 82. Then, the end flange 116 is manually pushed inwardly towards the swivel tube assembly 66 so as to move the locking end 108 over the top of the top flange 118, which locks the swivel tube assembly 66 on the transom bracket assembly 30. In other words, the locking end 108 prevents upward movement of the annular locking flange 86 and thus prevents removal of the swivel tube assembly 66 from the swivel cylinder 48. Movement of the locking end 108 over the top of the top flange 118 also moves the detent protrusion 121 from the outer recess to the inner recess of the spring clip 122, which retains the locking arm 104 in the position shown. The copilot handle or knob 134 is shown rotated into position wherein the shuttle 132 is moved outwardly away from the swivel tube assembly 66, permitting the natural bias of the spring 138 to move the friction arm 130 away from the annular friction ring 162, as shown, thus preventing frictional engagement between the inner end 160 and the annular friction ring 162, which frees the swivel tube assembly 66 and associated outboard motor 10 for steering movement.

FIG. 6 depicts the mechanism 100 in the locked position after the copilot handle or knob 134 has been manually rotated, as shown at arrow 200, such that the shuttle 132 is moved inwardly towards the swivel tube assembly 66, shown at arrow 201, which in turn moves the friction arm 130 towards and into frictional engagement with the annular friction ring 162, which frictional engagement resists or prevents steering movement of the swivel tube assembly 66 and associated tiller handle 78 and outboard motor 10 relative to the transom bracket assembly 30. Thus, FIG. 6 depicts the mechanism 100 in the locked position wherein the copilot arm 102 restricts steering movement of the outboard motor 10 about the steering axis 62.

Figure 7:
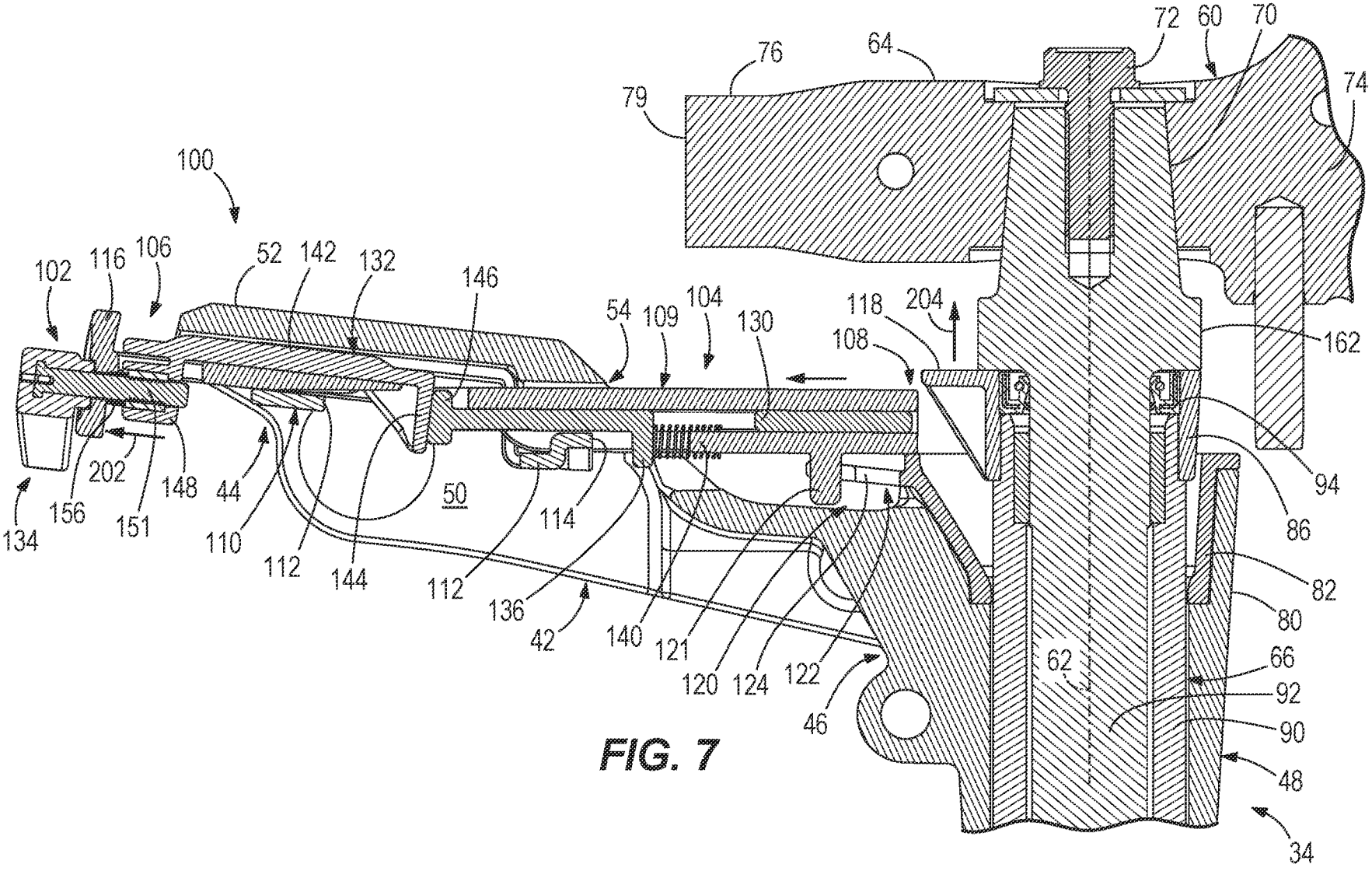
FIG. 7 is a view like FIG. 6, showing the mechanism in an unlocked position, permitting removal of the marine drive from the marine vessel.

FIG. 7 depicts the mechanism 100 in the unlocked position after the end flange 116 has been pulled/slid radially outwardly away from the swivel tube assembly 66, as shown at arrow 202, thus removing the locking end 108 from over the top flange 118 of the annular locking flange 86. This frees or unlocks the outboard motor 10 for removal from the transom bracket assembly 30, as shown at arrow 204. Advantageously, the copilot arm 102 remains in position relative to the locking arm 104, i.e., regardless of whether the locking arm 104 is in the locked position or in the unlocked position. That is, the frictional engagement setting of the copilot arm 102 remains constant when the locking arm 104 is moved into and between the locked and unlocked positions, thus allowing the operator of the mechanism 100 to lock and unlock the apparatus without losing their preferred frictional engagement (i.e., their preferred resistance to steering setting).

It will thus be seen that the present disclosure provides a novel, integrated copilot and locking mechanism comprising both a copilot arm for retaining a steering bracket on a marine drive in each of a plurality of steering orientations and a locking arm configured to lock and alternately unlock the steering bracket relative to the transom bracket assembly, in particular such that in a locked position the marine drive is retained on the transom bracket assembly and such that in an unlocked position the marine drive is removable from the transom bracket assembly. The novel mechanism includes a single, multifunctional handle end (106, 116, 134) which is efficiently operable to cause the integrated copilot and locking mechanism to retain the steering bracket in each of the plurality of steering orientations, and which is also operable to cause the integrated copilot and locking mechanism to lock and alternately unlock the steering bracket and the transom bracket assembly relative to each other.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An apparatus for supporting a marine drive on a marine vessel, the apparatus comprising:

a transom bracket assembly for mounting to the marine vessel, the transom bracket assembly comprising a swivel cylinder, a steering bracket for coupling the marine drive to the transom bracket assembly so the marine drive is steerable relative to the transom bracket assembly, the steering bracket comprising a steering arm and a swivel tube assembly that is seated in the swivel cylinder such that steering of the steering arm relative to the transom bracket assembly rotates the swivel tube assembly in the swivel cylinder, and a copilot mechanism configured to retain the steering bracket in a plurality of steering orientations, the copilot mechanism comprising a copilot arm that extends between a copilot handle or knob and an inner end that frictionally engages an outer surface of the swivel tube assembly to limit or prevent rotation of the swivel tube assembly in the swivel cylinder and thereby retain the steering bracket in each of a plurality of steering orientations.

2. The apparatus according to claim 1, wherein the copilot arm is movable radially towards and radially away from the swivel tube assembly to vary a strength of frictional engagement with the swivel tube assembly.

3. The apparatus according to claim 2, wherein the copilot handle or knob is rotatable to vary said strength of frictional engagement.

4. An apparatus for supporting a marine drive on a marine vessel, the apparatus comprising:

a transom bracket assembly for mounting to the marine vessel, the transom bracket assembly comprising a swivel cylinder, a steering bracket for coupling the marine drive to the transom bracket assembly so the marine drive is steerable relative to the transom bracket assembly, the steering bracket comprising a steering arm and a swivel tube assembly that is seated in the swivel cylinder such that steering of the steering arm relative to the transom bracket assembly rotates the swivel tube assembly in the swivel cylinder, and a copilot mechanism configured to retain the steering bracket in a plurality of steering orientations, the copilot mechanism comprising a copilot arm that frictionally engages an outer surface of the swivel tube assembly to limit or prevent rotation of the swivel tube assembly in the swivel cylinder and thereby retain the steering bracket in each of a plurality of steering orientations.

5. The apparatus according to claim 4, wherein the copilot arm comprises a copilot handle or knob and a friction arm having an inner end that engages the outer surface of the swivel tube assembly.

6. The apparatus according to claim 5, wherein the copilot arm has an inner end with a concave surface that generally conforms to the outer surface of the swivel tube assembly.

7. The apparatus according to claim 5, wherein rotation of the copilot handle or knob in a first direction moves the inner end into frictional engagement with the outer surface of the swivel tube assembly and wherein rotation of the copilot handle or knob in a second direction that is opposite the first direction moves the inner end out of frictional engagement with the outer surface of the swivel tube assembly.

8. The apparatus according to claim 7, wherein rotation of the copilot handle or knob varies a strength of said frictional engagement.

9. The apparatus according to claim 7, wherein the copilot arm is spring biased away from said frictional engagement.

10. The apparatus according to claim 9, wherein the copilot arm comprises a shuttle and a spring that biases the shuttle away from the swivel tube assembly.

11. The apparatus according to claim 4, wherein the copilot arm is spring biased away from frictional engagement with the outer surface of the swivel tube assembly.

12. The apparatus according to claim 4, further comprising an annular friction ring providing the outer surface on the swivel tube assembly.

13. The apparatus according to claim 4, further comprising a locking arm configured to lock and unlock the steering bracket relative to the transom bracket assembly.

14. The apparatus according to claim 13, wherein the copilot arm and the locking arm are parallel.

15. The apparatus according to claim 13, wherein the copilot arm and the locking arm are coaxial.

16. The apparatus according to claim 13, wherein the copilot arm is supported on and movable relative to the locking arm.

17. The apparatus according to claim 13, further comprising a multifunctional handle end that is operable to cause the copilot mechanism to retain the steering bracket in each of the plurality of steering orientations and also operable to cause the locking arm to lock and unlock the steering bracket relative to the transom bracket assembly.

18. An integrated copilot and locking mechanism for a marine drive, the integrated copilot and locking mechanism comprising:

a copilot arm configured to retain a steering bracket on the marine drive in each of a plurality of steering orientations relative to a transom bracket assembly, a locking arm configured to lock and alternately unlock the steering bracket relative to the transom bracket assembly such that in a locked position the marine drive is retained on the transom bracket assembly and such that in an unlocked position the marine drive is removable from the transom bracket assembly, and a multifunctional handle end that is operable to cause the copilot arm to retain the steering bracket in each of the plurality of steering orientations and also operable to cause the locking arm to lock and unlock the steering bracket relative to the transom bracket assembly.

19. The integrated copilot and locking mechanism according to claim 18, wherein the copilot arm and the locking arm are coaxial.

20. The integrated copilot and locking mechanism according to claim 18, wherein the multifunctional handle is configured to move the copilot arm parallel to the locking arm.

* * * * *